US012053065B2

(12) United States Patent
Ng

(10) Patent No.: US 12,053,065 B2
(45) Date of Patent: Aug. 6, 2024

(54) BEAD WITH ORIENTATION FEATURES FOR BRUNNIAN LINKED ITEM

(71) Applicant: Choon's Design LLC, Farmington Hills, MI (US)

(72) Inventor: Cheong Choon Ng, Novi, MI (US)

(73) Assignee: CHOON'S DESIGN LLC, Farmington Hills, MI (US)

( * ) Notice: Subject to any disclaimer, the term of this patent is extended or adjusted under 35 U.S.C. 154(b) by 40 days.

(21) Appl. No.: 17/942,384

(22) Filed: Sep. 12, 2022

(65) Prior Publication Data

US 2024/0081494 A1 Mar. 14, 2024

(51) Int. Cl.
*A44C 5/02* (2006.01)
*A44C 27/00* (2006.01)

(52) U.S. Cl.
CPC ..... *A44C 5/02* (2013.01); *A44C 27/00* (2013.01)

(58) Field of Classification Search
CPC ..... A44C 5/02; A44C 27/00; A44C 5/0053; A44C 5/0069; A44C 5/027; A44C 5/025; A44C 5/08; D04D 1/04; Y10T 29/49591; Y10T 29/49838; Y10T 29/53696
USPC ..... 223/48, 99
See application file for complete search history.

(56) References Cited

U.S. PATENT DOCUMENTS 1,694,703 A * 12/1928 Doppenschmitt ..... A44C 5/025 63/3
1,994,659 A * 3/1935 De ..... D04G 3/02 139/420 R
4,879,882 A * 11/1989 Johnson ..... A44C 15/004 63/4
5,197,175 A * 3/1993 Yuen ..... D04D 1/04 29/241
5,664,707 A * 9/1997 Spector ..... D04D 1/04 29/241
7,124,918 B2 * 10/2006 Rascoe ..... D04D 1/04 223/48
8,622,441 B1 * 1/2014 Ng ..... D04D 1/00 289/17
9,149,096 B2 * 10/2015 Ng ..... A44C 5/0069
2004/0177859 A1 * 9/2004 Coleman ..... A45D 8/12 132/275
2010/0212770 A1 * 8/2010 Weidler ..... D03D 29/00 139/33
2012/0112457 A1 * 5/2012 Ng ..... D04D 11/00 289/1.5

(Continued)

FOREIGN PATENT DOCUMENTS

AU 2019100673 A4 * 7/2019 ..... A44C 25/007
FR 1460161 A * 11/1965
WO 2018172933 A1 9/2018

OTHER PUBLICATIONS

European Search Report for European Application No. 23197499.9 mailed Mar. 11, 2024.

*Primary Examiner* — Jack W Lavinder
(74) *Attorney, Agent, or Firm* — Carlson, Gaskey & Olds, P.C.

(57) ABSTRACT

A Brunnian link is a link formed from a closed loop doubled over itself to capture another closed loop to form a chain. One or more beads may be assembled to a linked item formed with Brunnian links. The beads include tapered sides to provide a curved interface that corresponds with the shape of a completed linked item.

14 Claims, 11 Drawing Sheets

(56) References Cited

U.S. PATENT DOCUMENTS

| | | | | |
|---|---|---|---|---|
| 2014/0239635 | A1* | 8/2014 | Ng | D03D 29/00 289/17 |
| 2015/0296937 | A1* | 10/2015 | Ng | D04D 11/00 289/17 |
| 2020/0367616 | A1 | 11/2020 | Ng | |

* cited by examiner

BEAD WITH ORIENTATION FEATURES FOR BRUNNIAN LINKED ITEM

BACKGROUND

Kits that include materials for making a uniquely colored bracelet or necklace have always enjoyed some popularity. However, such kits usually just include the raw materials such as different colored threads and beads and rely on the individual's skill and talent to construct a usable and desirable item.

SUMMARY

A Brunnian link is a link formed from a closed loop doubled over itself to capture another closed loop to form a chain. Elastic bands can be utilized to form such links and created a linked item such as a bracelet. An example disclosed bead can be assembled to the linked item and includes features to maintain an orientation once assembled to the linked item. An example disclosed hook tool aids in assembly of the disclosed beads in a desired orientation. The bead and hook tool may form parts of a kit that further includes a plurality of elastic closed loop members and clips for securing ends of a formed linked item.

Although the different examples have the specific components shown in the illustrations, embodiments of this invention are not limited to those particular combinations. It is possible to use some of the components or features from one of the examples in combination with features or components from another one of the examples.

These and other features disclosed herein can be best understood from the following specification and drawings, the following of which is a brief description.

DETAILED DESCRIPTION

Figure 1:
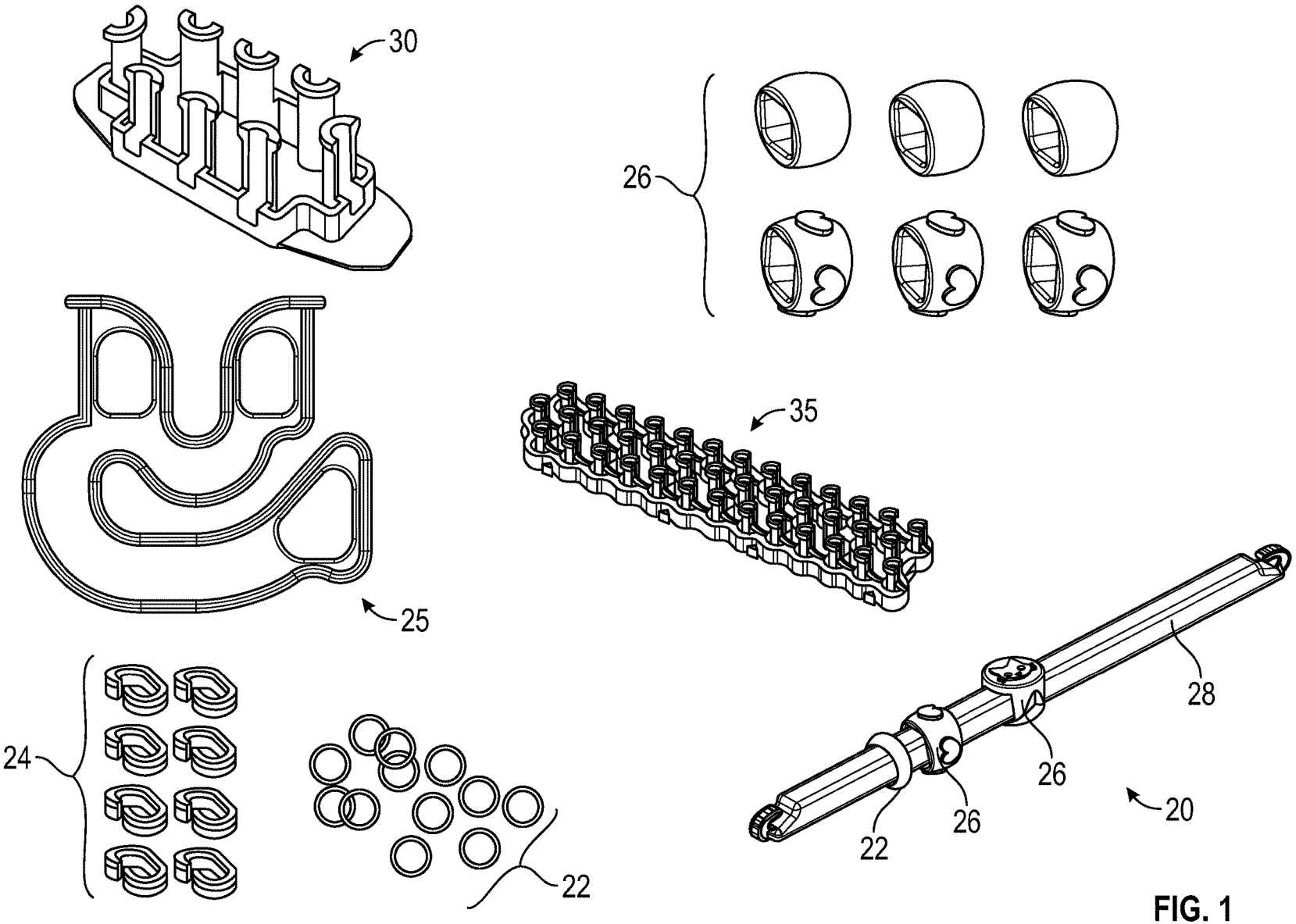
FIG. 1 is a perspective view of an example kit including beads, a hook took, elastic loops and clips according to a disclosed example embodiment.
Figure 2:
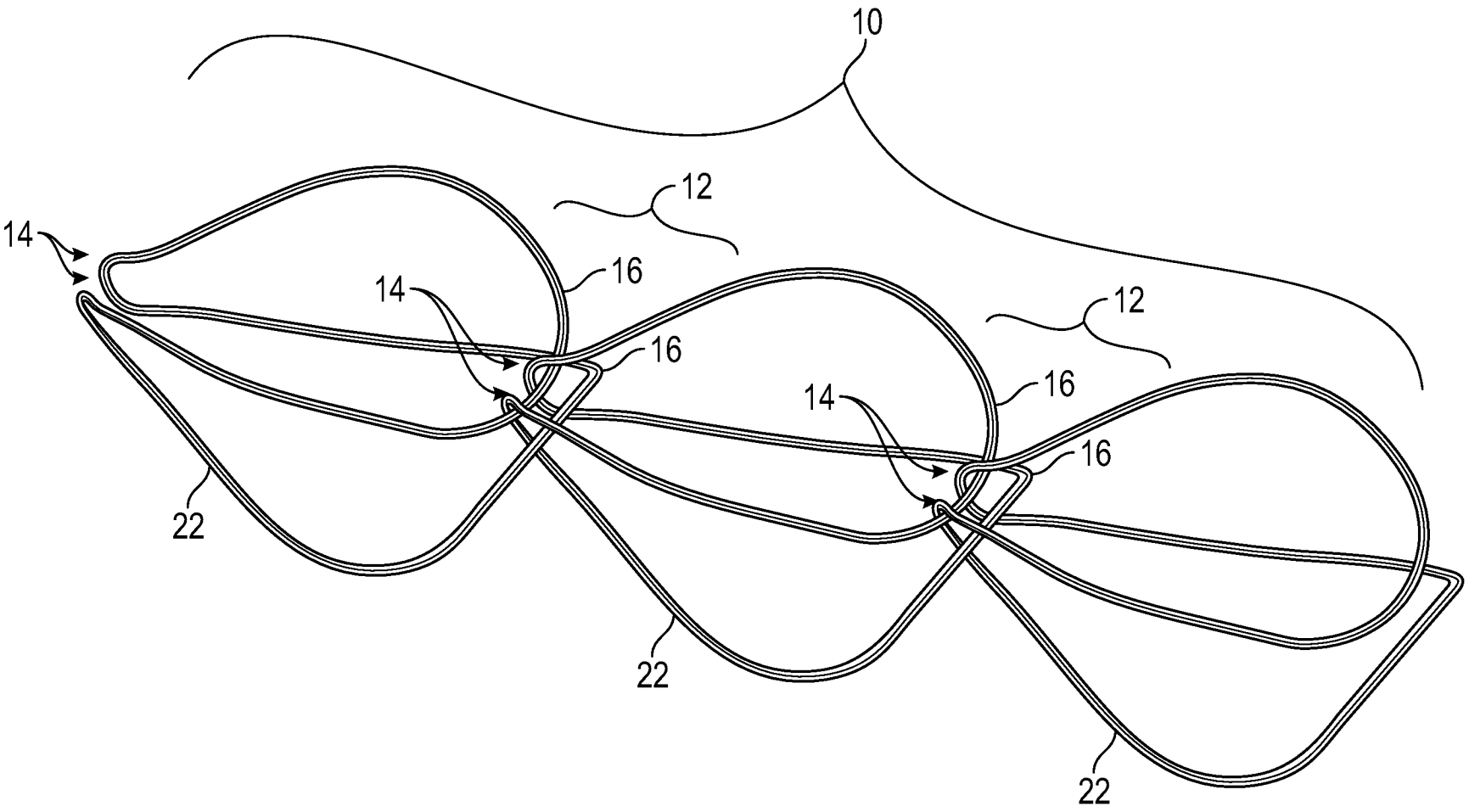
FIG. 2 is schematic view of an example of several elastic loops secured by Brunnian links.
Figure 3:
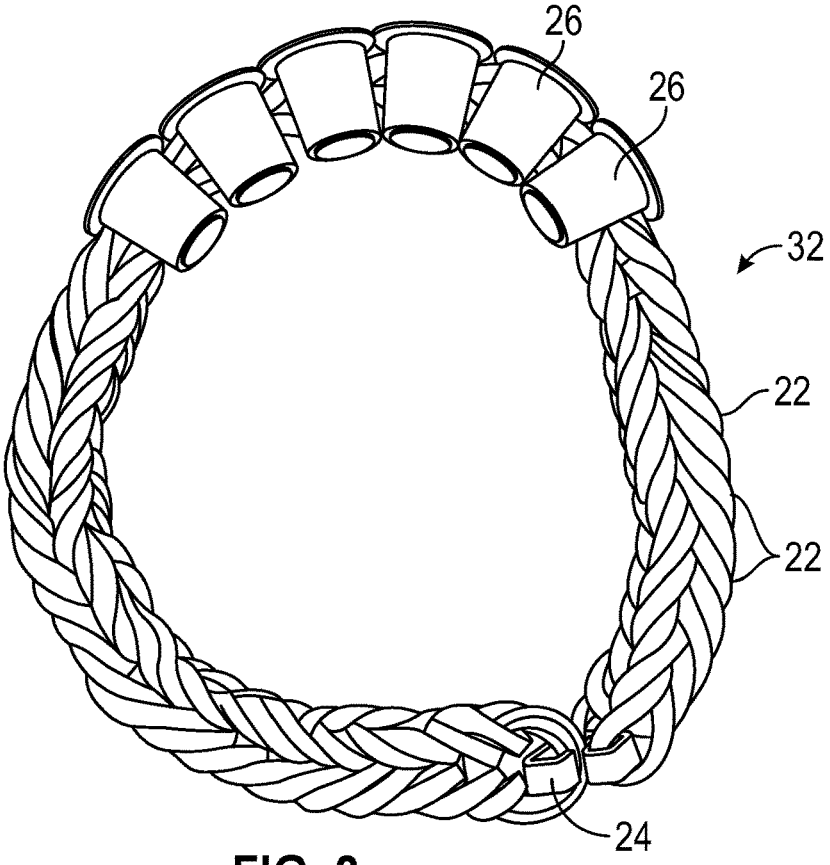
FIG. 3 is a front view of a completed Brunnian linked items with several beads according to an example embodiment.
Figure 4:
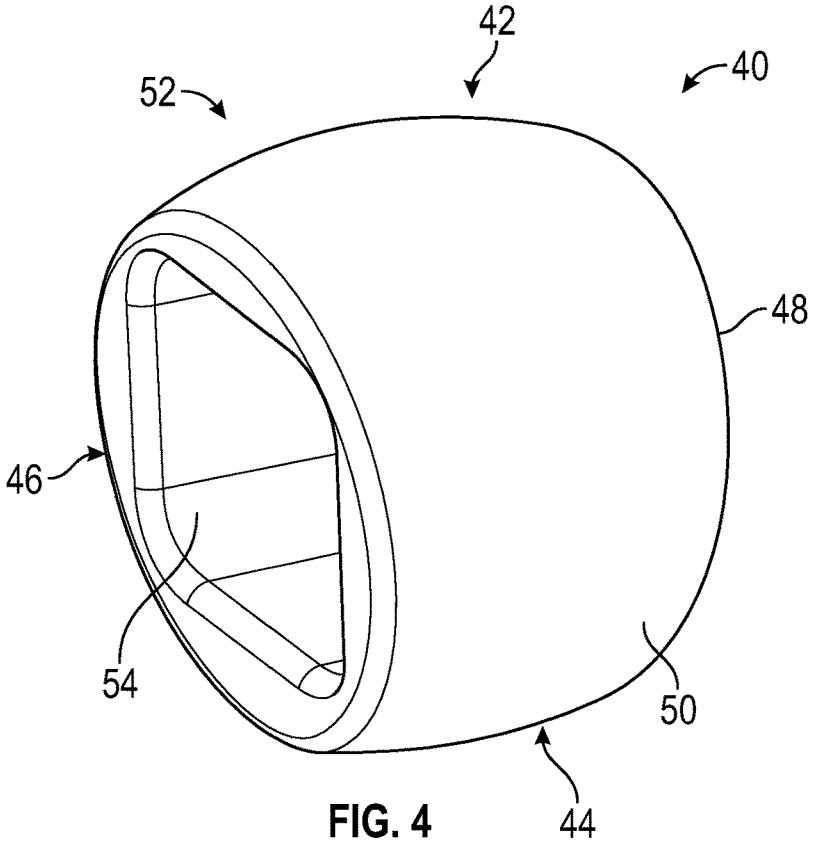
FIG. 4 is a perspective view of an example tapered bead.
Figure 5:
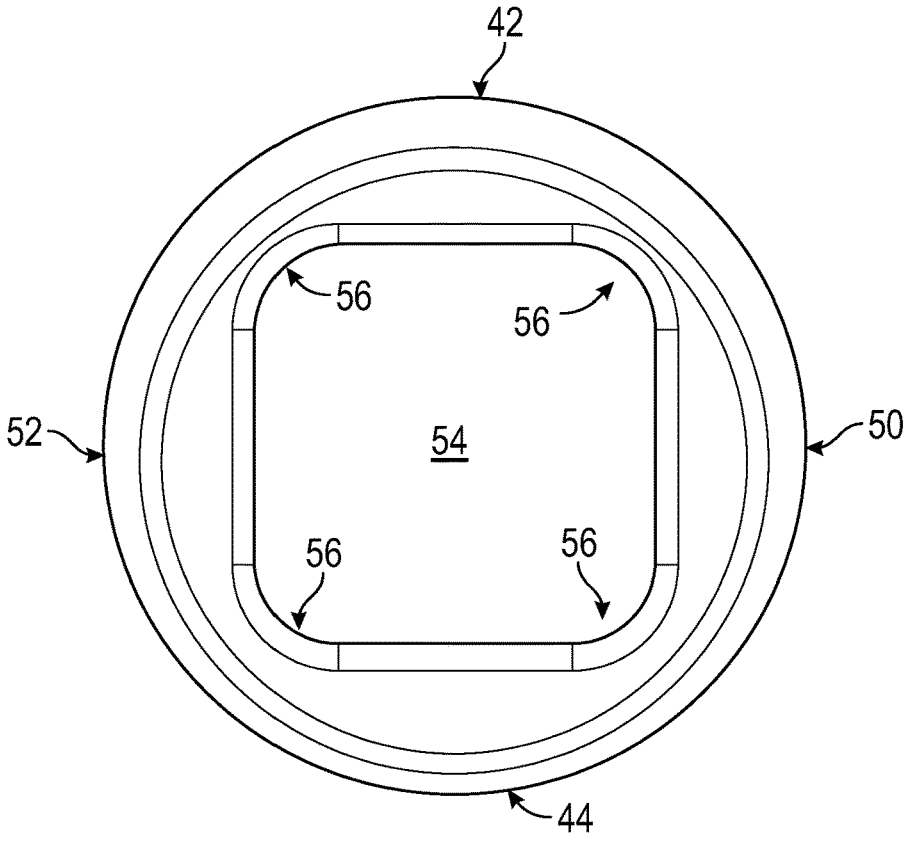
FIG. 5 is a front view of the example tapered bead.

Referring to FIGS. 1, 2 and 3 an example kit 20 for creating a linked item 32 is shown. The kit 20 includes, at least, a plurality of closed loop elastic bands 22, a plurality of clips 24, a plurality of beads 26 and a hook tool 28. The hook tool 28 is utilized to assembly beads 26 onto a linked article formed from the elastic bands 22. The clips 24 is utilized to secure ends of the linked article formed from the elastic bands 22. The kit 20 may also include a loom for holding the elastic bands as they are linked together. The loom may be one of several example loom embodiments 25, 30 and 30 shown that provide for holding and arranging the elastic bands 22 as they are linked together. Each of the example looms 25, 30 and 35 include of pins and/or arms with features for holding a plurality of elastic bands 22 relative to each other during creation of the links.

Referring to FIG. 2 with continued reference to FIGS. 1 and 3, a series of links is schematically shown at 10 and is formed from a plurality of the elastic bands 22 using a Brunnian link 12. A Brunnian link is formed between two continuous closed looped structures such as elastic bands 22 without forming an actual knot. Each Brunnian link 12 is formed by capturing ends 14 of one elastic band 22 with a mid-portion 16 of another elastic band 22. Each link 12 depends on the previous and subsequent links 12 to maintain a desired linked article as shown. Although a bracelet 10 is shown by way of example, other articles can be formed utilizing different Brunnian link structures and are within the scope and contemplation of this disclosure.

The beads 26 have a rectilinear opening for assembly to the linked item 32. In one disclosed embodiment, the rectilinear opening is square with rounded corners. The square shaped opening of the beads 26 orientates each bead 26 on the linked item 32 such that a plurality of beads may be arranged in a desired orientation. Moreover, the square opening provides for the desired orientation to be maintained once the linked item is completed.

Referring to FIGS. 4-9, an example bead 40 includes a top 42, a bottom 44, a front 46, a back 48, a first side 50 and a second side 52. An opening 54 extends through the bead 40 from the front 46 to the back 48. The example opening 54 is rectilinear with flat sides and rounded corners 56. In one disclosed example, the opening 54 is square shaped with the flat sides being of substantially equal length.

The square shaped opening 54 is sized to correspond with a size and shape of a linked item 32 as show in FIG. 3. A simple Brunnian link 12 is illustrated in FIG. 3, however, more complex linking structure can be formed using the same linking techniques. One such linking structure can provide a substantially square shaped cross-section. The square shaped opening 54 corresponds with such a square shaped link structure to maintain a desired orientation of the bead when assembled onto the linked structure.

Figure 6:
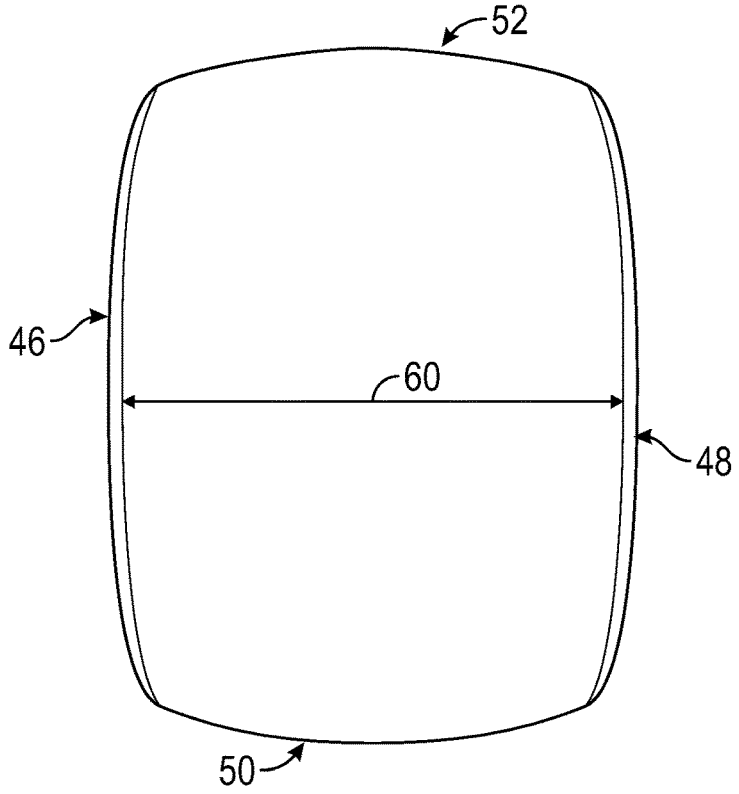
FIG. 6 is a top view of the example tapered bead.
Figure 7:
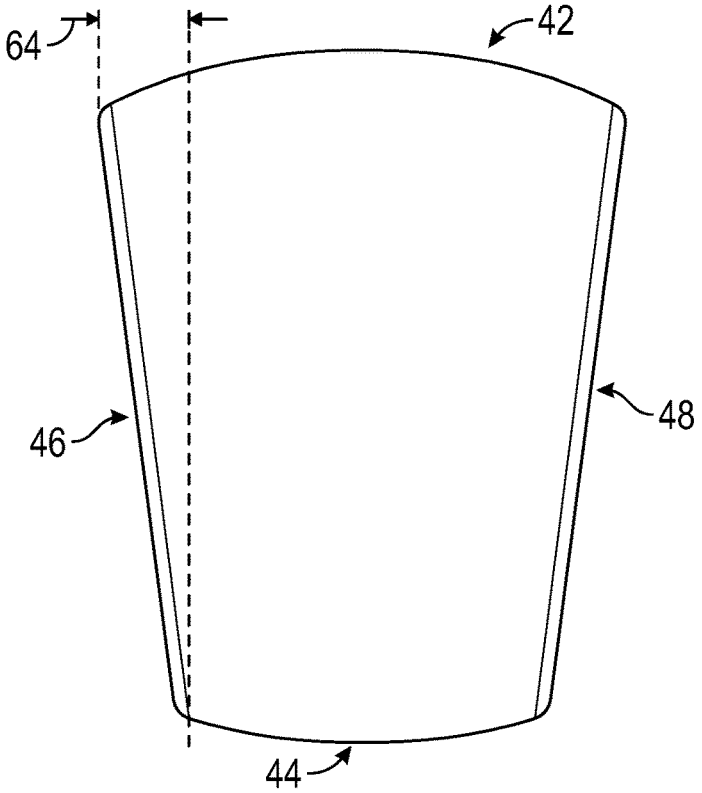
FIG. 7 is a side view of the example tapered bead.

The example bead 40 further includes a tapered front 46 and back 48 as is best shown in FIG. 7. The taper is defined such that a top width 60 (FIG. 6) of the top 42 is greater than a bottom width 62 (FIG. 8) of the bottom 44. The taper is further defined by an angle 64 relative to a normal or straight line through the bead 40. The angle 64, in one disclosed example embodiment, is between about 2° and 45°. In another disclose example, the angle 64 is between about 8° and 15°. In still another disclosed example, the angle 64 is between 8° and 12°. In an additional disclosed example, the angle 64 is 10°. It should be appreciated that other taper angles may be utilized within the scope and contemplation of this disclosure.

Figure 8:
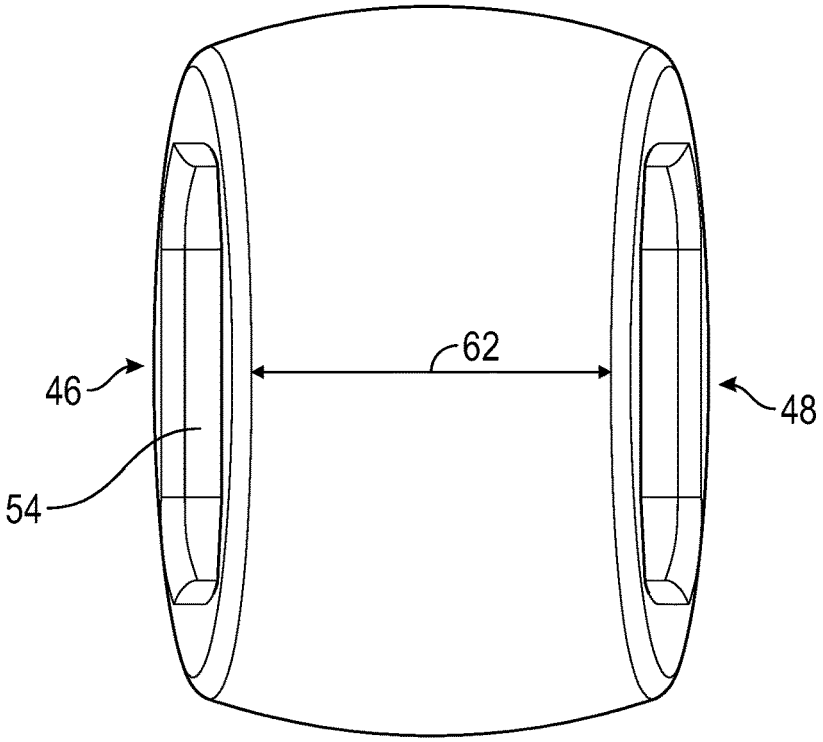
FIG. 8 is a bottom view of the example tapered bead.

Referring to FIG. 3 with continued reference to FIGS. 6-8, the linked item 32 is shown with beads 26. The beads 26 shown on the linked item 32 are configured in the same manner as the bead 40 shown in FIGS. 6-8. The tapered front 46 and back 48 provide for the beads 40 to conform to a curvature of the completed linked item 32. In this example, the linked item 32 is a bracelet and forms a closed generally circular shape. The tapered front 46 and back 48 provide for the beads 40 to substantially follow the curvature and circular shape of the linked item 32. The front 46 and back 48 of the beads 28, 40 abut each other and form a corresponding curvature on the linked item 32. Additionally, the square shaped opening 54 maintains the set orientation of the beads 26, 40 once assembled to the linked item 32.

Figure 9:
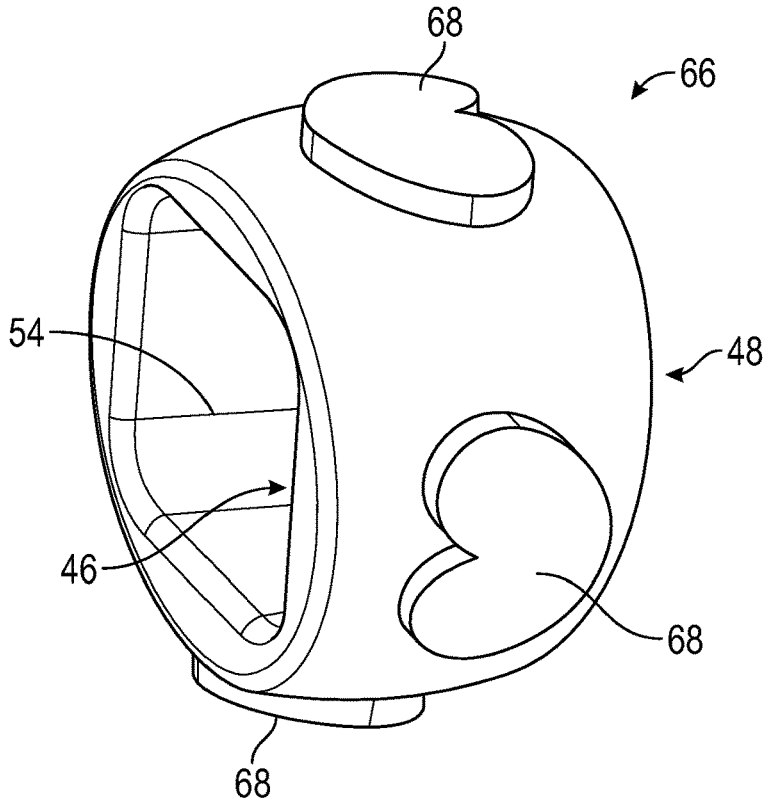
FIG. 9 is a perspective view of another example tapered bead.

Referring to FIG. 9, another example bead embodiment 66 includes a decorative shape or icon 68. In this example, the bead 66 includes a heart shape 68 on each of the sides. The bead 66 includes the inner opening and tapered sides features and adds the decorative shape 68. The disclosed beads 26, 40 and 66 may be of different colors and outer shapes and maintain the square inner opening and tapered front and back features to provide different aesthetic creative possibilities for creation of a linked item. Moreover, the decorative shape 68 may be an embossed surface rather than the raised decorative surface 68 shown in the example bead 66.

Figure 10:
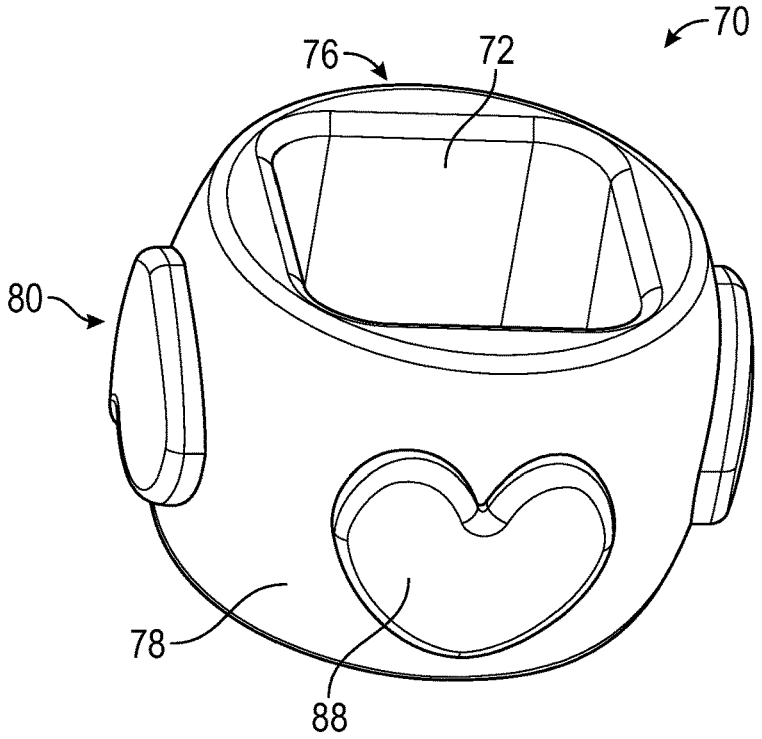
FIG. 10 is a perspective view of an example square inner space bead.
Figure 11:
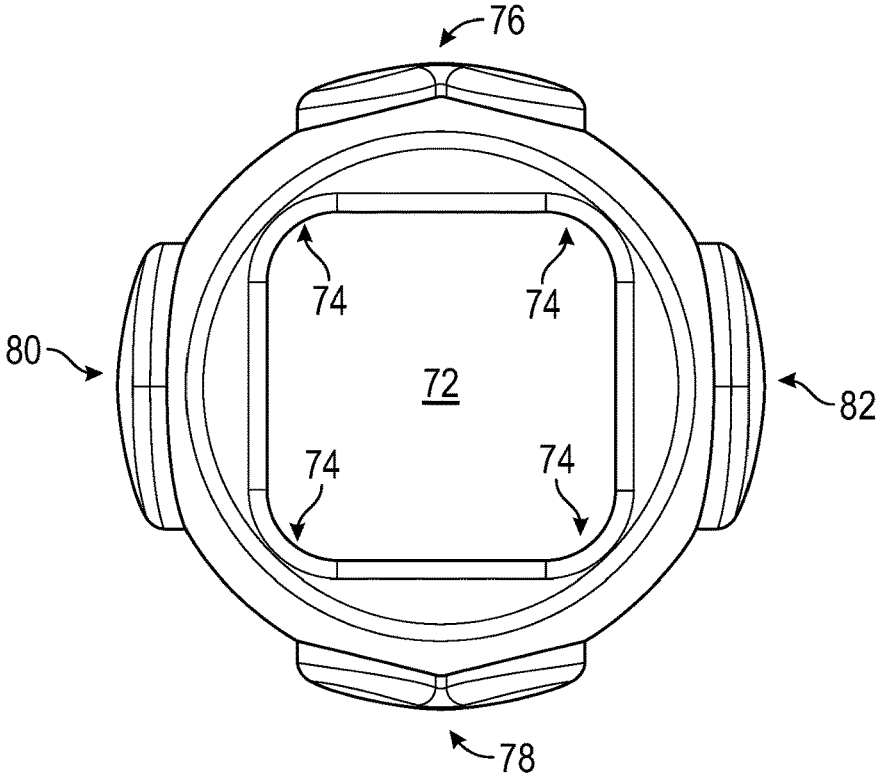
FIG. 11 is a front view of the example square inner space bead.
Figure 12:
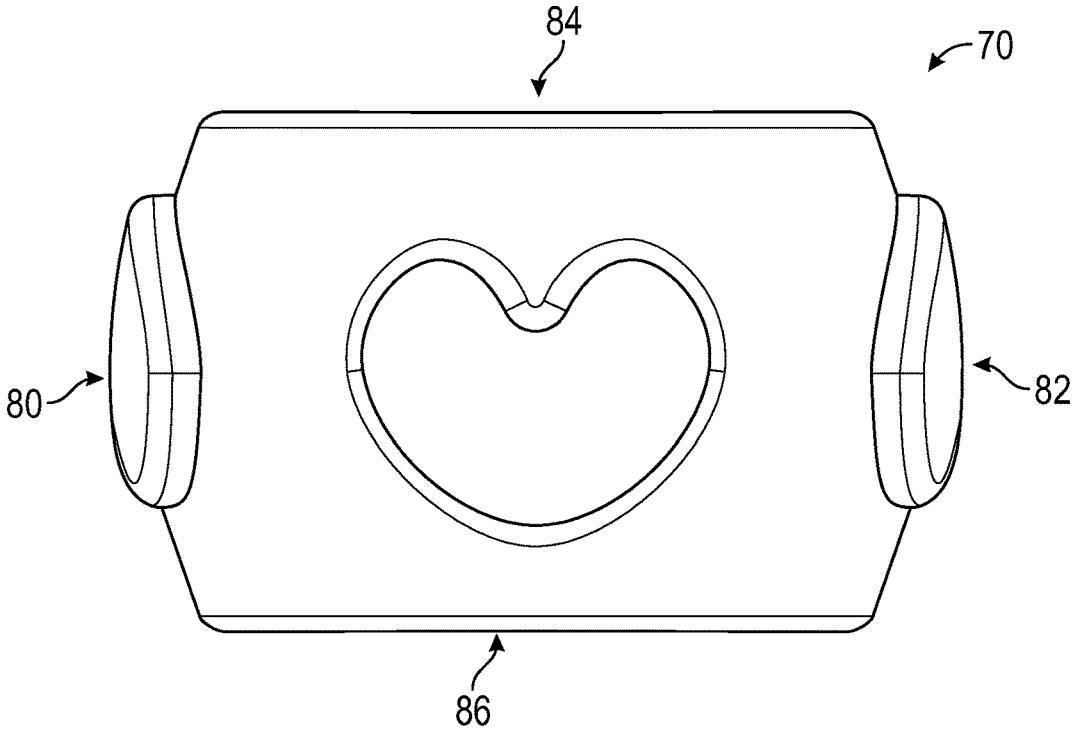
FIG. 12 is a top view of the example square inner space bead.

Referring to FIGS. 10-12, another example bead 70 is shown and includes a square shaped opening 72 with rounded corners 74. The example bead 70 includes a top 76, bottom 78, first side 80, second side 82, front 84 and back 86. The opening 72 extends from the front 84 to the back 86. The example bead 70 includes straight sides on the front 84 and back 86. The bead includes a symbol 88 that is a raised heart shape. The symbol 88 may be other shapes such as for example, letters, cartoons and any other shape that would be of interest to provide a desirable appearance.

Figure 13:
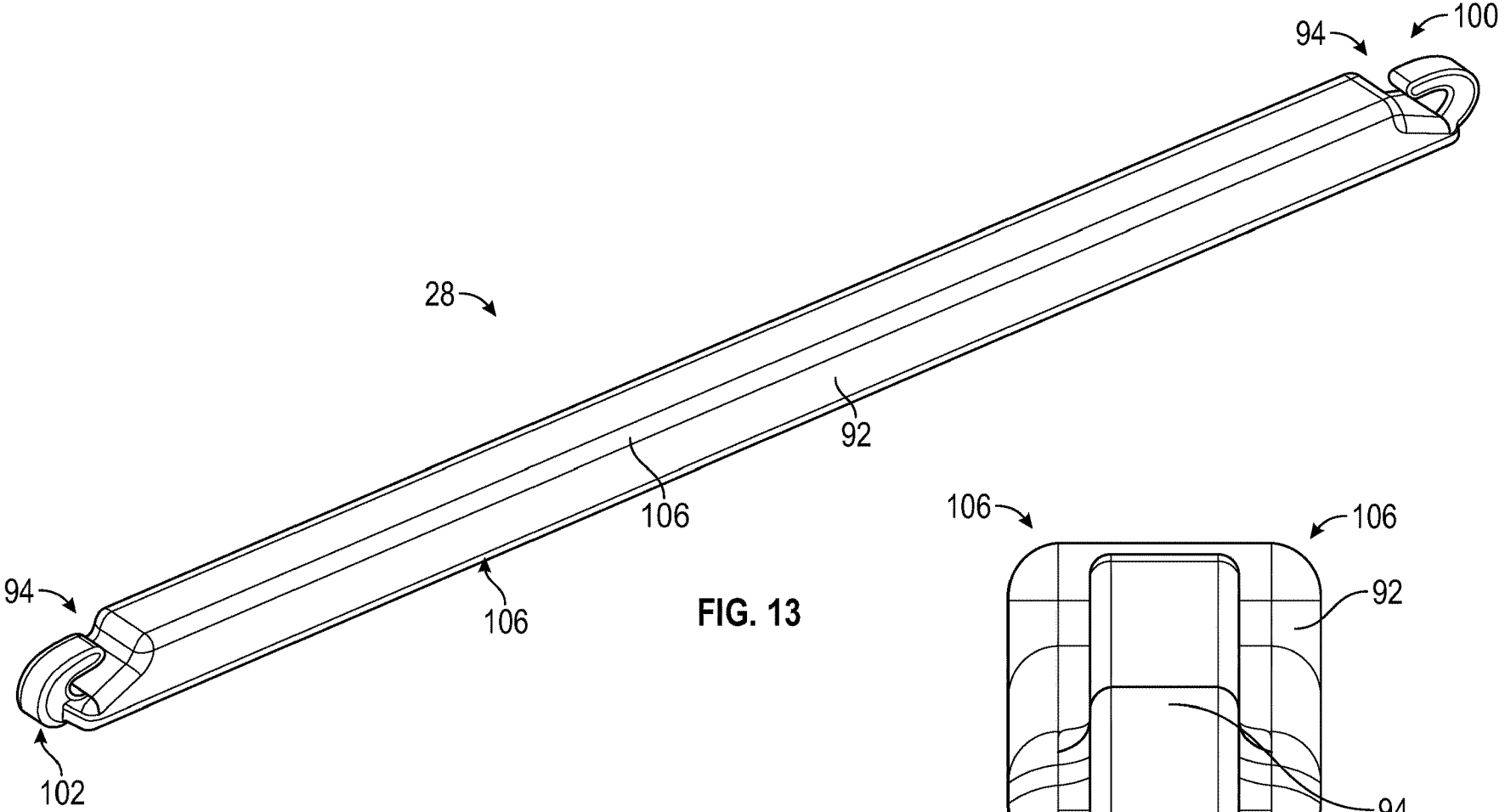
FIG. 13 is a perspective view of an example hook tool embodiment.
Figure 14:
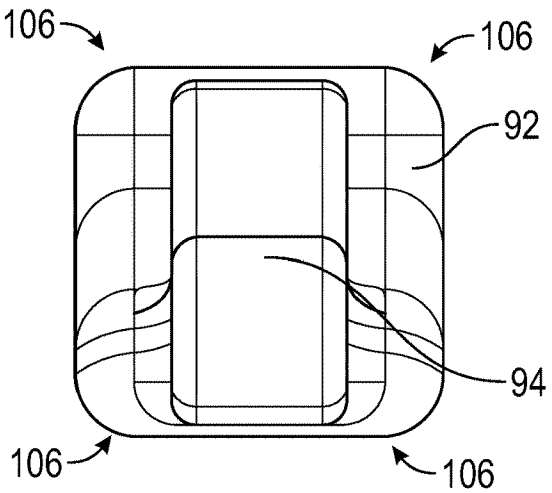
FIG. 14 is an end view of the example hook tool embodiment.
Figure 15:
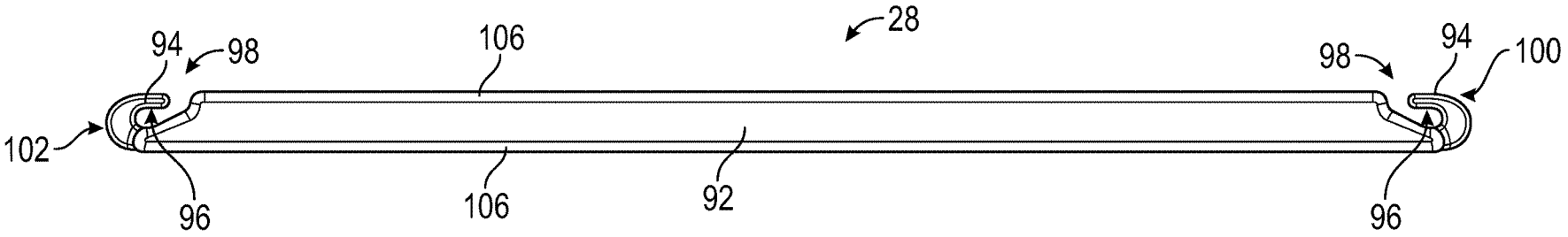
FIG. 15 is a side view of the example hook tool embodiment.

Referring to FIGS. 13, 14 and 15, the example hook tool 28 is shown and includes a square shaped body portion 92 and hook portions 94 disposed at each of the first end 100 and the second end 102. Each of the hook portions 94 include an open area 96 for receiving an elastic band portion through a lead opening 98. The square shaped body portion 92 is sized to receive the square shaped opening of the beads 28, 40, 66, 70. Additionally, the body portion 92 includes rounded edges 106 that correspond with the rounded corners provided in the openings of the beads.

The hook tool 28 provides for assembly of the beads onto a linked item. Beads are assembled and arranged on the body portion 92 and one end of the linked item is attached to the hook portion 94. The beads on the body portion 92 are then slide past the hook portion 94, off the corresponding one of the ends 100, 102 and onto the linked item. The hook portion 94 is arranged such that it is no bigger than the body portion 92 to enable the beads to move freely onto the linked item.

Figure 16:
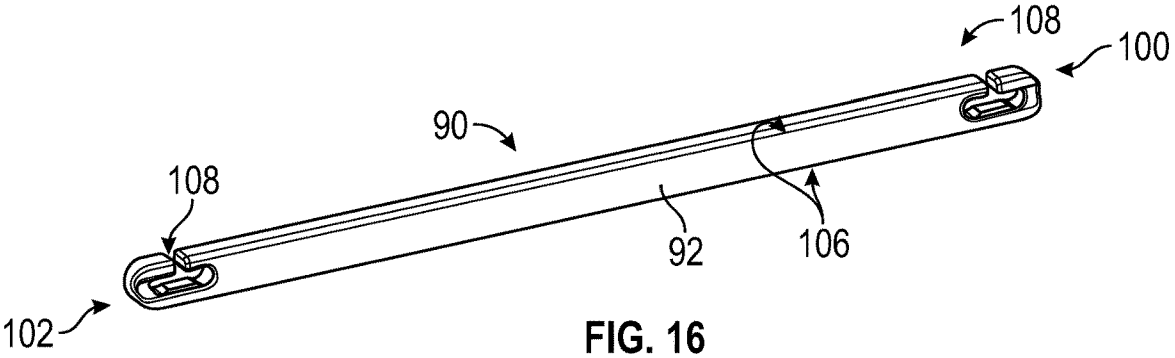
FIG. 16 is a perspective view of another example hook tool embodiment.
Figure 17:
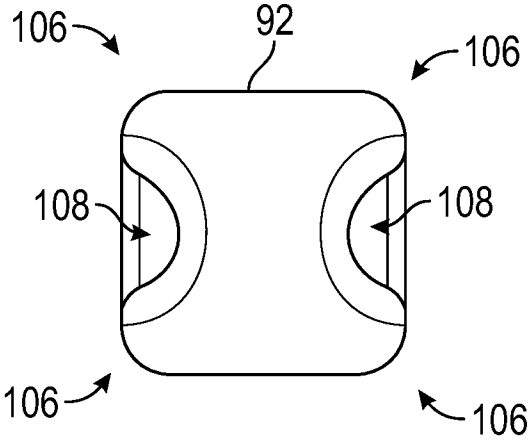
FIG. 17 is an end view of the example hook tool embodiment of FIG. 16.
Figure 18:
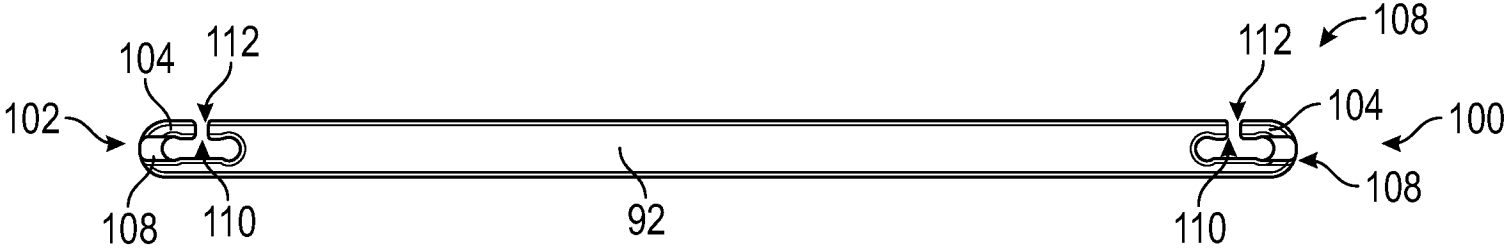
FIG. 18 is a side view of the example hook tool embodiment of FIG. 16.

Referring to FIGS. 16, 17 and 18, another example hook tool embodiment is indicated at 90 and includes the same body portion 92 with rounded edges 106 as provided in the previous hook tool embodiment 28. The hook tool 90 includes a catch portion 108 that provides for capturing and holding elastic bands at an end of a linked item. The catch portion 108 includes a hook 104, an open inner area 110 and a slot 112. The slot 112 is spaced from each of the corresponding ends 100, 102 and is centered over the open inner area 110. The slot 112 and open inner area 110 traps and hold elastic bands at the end of a linked item. The narrow slot 112 inhibits the ends of the elastic bands from errantly coming loose during assembly. Additionally, each of the ends 100, 102 include side grooves 108 that provides a space for a portion of the elastic bands as the beads are slid past and onto the linked item 32.

Figure 19:
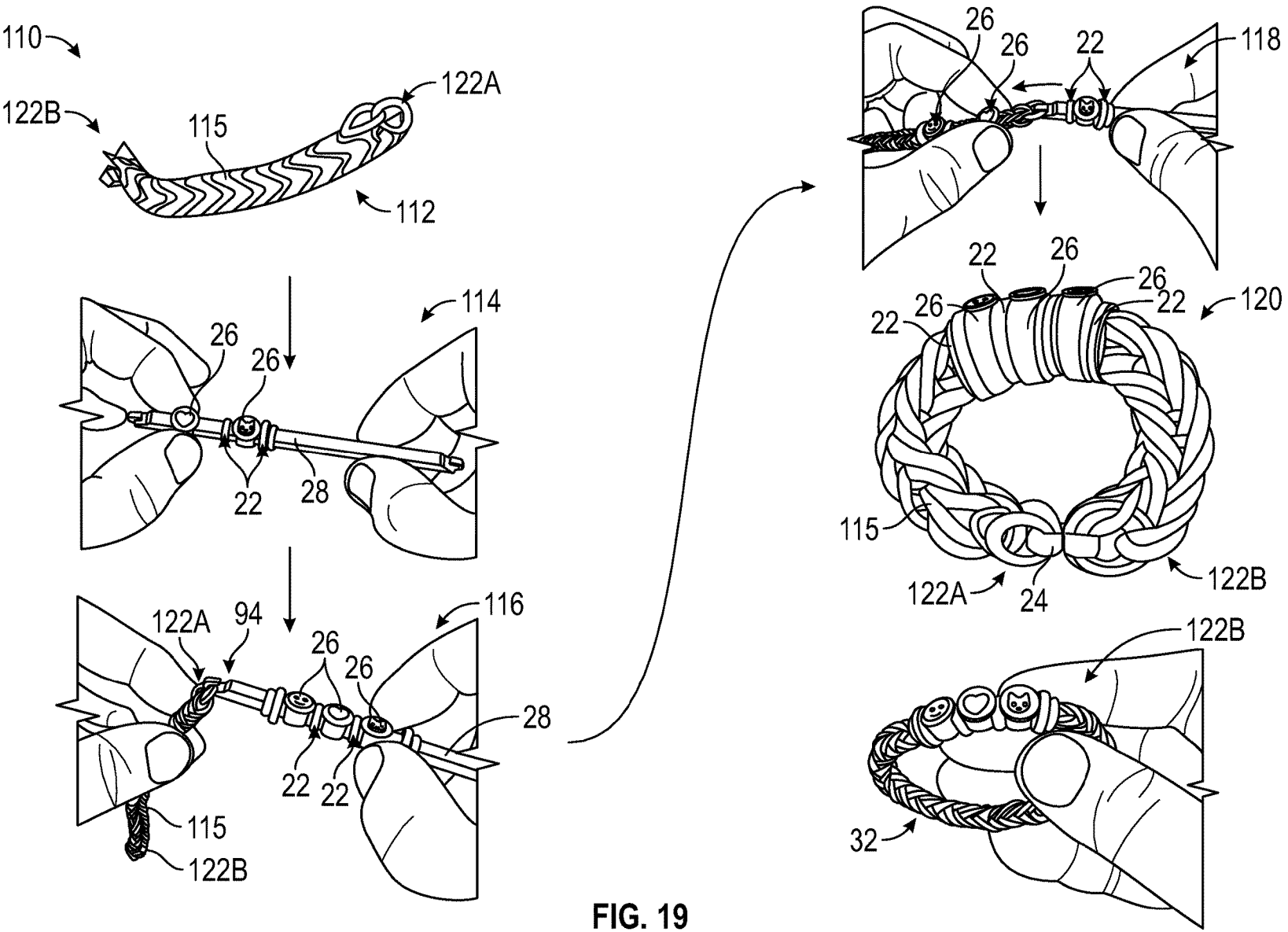
FIG. 19 is a schematic view of a method of assembling a linked item including several beads.

Referring to FIG. 19 with continued reference to the preceding Figures, a method of forming a linked item with at least one bead is schematically shown and indicated at 110. The method 110 includes an initial step 112 of forming a linked item 115 from a plurality of closed loop elastic members 22. The closed loop elastic members 22 are linked together using Brunnian link techniques to form a linked item of a desired length. The length is as desired by a user and corresponds with the desired final linked item. In this disclosed example, the final completed linked item is a bracelet. The linked item 115 may be formed utilizing known techniques that can include the use of any of the example looms 25, 30 and 35 shown in FIG. 1. It should be appreciated, that although example looms 25, 30 and 35 are shown in FIG. 1, other loom devices and structures can be utilized within the scope and contemplation of this disclosure.

A desired number of beads 26 are assembled onto the hook tool 28 as shown at 114. The beads 26 are arranged in a desired order that corresponds with the completed bracelet. In this disclosed example, elastic bands 22 are placed between the beads 26. The elastic bands 22 provide a spacing between beads 26 and frictionally engage the body of the hook tool 28. The frictional engagement provided by the elastic bands 2 holds the beads 26 in place on the hook tool 28.

Once the beads 26 and elastic bands 22 are arranged as desired on the hook tool 28, the linked item 115 is attached to one of the hook portions 94. An end 122A is attached to the hook portion 94 by threading elastic bands at the end 122A onto the hook. As appreciated, either hook tool 28 (FIG. 13) or the hook tool 90 (FIG. 16) could be utilized for assembling the beads 26 onto the linked item 115. The hook tool 28 includes first and second ends 100, 102 with the linked item 115 attached to only one end. Depending on the size of the linked item 115, both ends 122A and 122B could be attached to corresponding first and second ends 100, 102 of the hook tool 28. However, only one end needs to be connected to provide for assembly of the beads 26.

Once the linked item 115 is attached, the beads 26 and elastic bands 22 are slide from the hook tool 28 onto the linked item 115 as shown at 118. The square shaped body of the hook tool 28 holds the beads 26 in a desired orientation as they are slide onto the linked item 115. The linked item 115 may have a corresponding substantially square shape so that the beads 26 maintain the orientation set while on the hook tool 28. However, the linked item 115 may have other shapes that will also benefit from the set orientation of beads on the hook tool 28. In this example, the square shape of the linked item is aligned with the square shape of the body portion 92 of the hook tool 28. The alignment is set when the linked item 115 is hooked to the hook tool 28 and maintained by the user during assembly.

Once the beads 26 are set onto the linked item as shown at 120, the ends 122A and 122B of the linked item 115 are connected with a clip 24. The clip 24 includes features that hold the closed loop elastic members to prevent undesired unraveling of the completed linked item indicated at 32. The elastic bands 22 that are disposed between the beads 26 hold the desired and set position on the linked item 115 such that the desired orientation is held. Holding of the beads is of particular utility when beads that include letters to spell out a specific word, saying or phrase are included in the completed linked item 32.

Accordingly, the beads and hook tool provided in the example kit 20 provide many different alternatives for creation of a linked item. The square shape of the bead and corresponding hook tool provide for planning, setting and maintaining the bead orientation during assembly and once installed on the linked item.

Although an example embodiment has been disclosed, a worker of ordinary skill in this art would recognize that certain modifications would come within the scope of this disclosure. Moreover, no part of this disclosure is intended, either explicitly or implicitly, as any disclaimer or narrowing of claim scope. The description of any one embodiment is not intended, either explicitly or implicitly, as limiting the plain and ordinary meaning set out in the following claims. The example embodiment is only one of many possible structures and methods that are properly within the scope of this disclosure. For these reasons, the following claims should be studied to determine the scope and content of this invention.

What is claimed is:

1. A kit for creating a linked item, the kit comprising:
at least one bead having a rectilinear inner opening;
a plurality of closed loop elastic members; and
a least one clip for securing ends of a plurality of linked closed loop elastic members, wherein the at least one bead is configured to be received on the plurality of linked closed loop elastic members, wherein the at least one bead includes at least one tapered side.

2. The kit as recited in claim 1, wherein the at least one bead includes a top, bottom, front, back, first side and a second side, wherein the front and back are tapered.

3. The kit as recited in claim 2, wherein the front and the back taper inward from the top toward the bottom such that a top width between the front and the back is larger near the top than a bottom width near the bottom.

4. The kit as recited in claim 3, wherein the taper is disposed at an angle relative to normal, the angle being between 2° and 45°.

5. The kit as recited in claim 3, wherein the taper is disposed at an angle that provides for adjacent beads to form a curve corresponding to a curve of the plurality of closed loop elastic members when the ends are secured together with the clip.

6. The kit as recited in claim 1, wherein the rectilinear inner opening is a square shape with rounded corners.

7. The kit as recited in claim 1, including a hook tool, the hook tool including a rectilinear cross-section corresponding to the rectilinear inner opening of the at least one bead.

8. The kit as recited in claim 7, wherein the hook tool includes a hook disposed on both a first end and a second end.

9. The kit as recited in claim 8, wherein the hook comprises an inner open area and an opening spaced apart from the corresponding one of the first end and the second end.

10. The kit as recited in claim 9, wherein the opening is centered over the inner open area.

11. A method of forming a linked item with at least one bead, the method comprising:
forming a linked item with a plurality of closed loop elastic bands, the linked item including a first end and a second end;
assembly at least one bead onto a body portion of a hook tool, wherein the at least one bead includes a rectilinear inner opening and the body portion of the hook tool includes a corresponding rectilinear shape;
attaching one of the first end and the second end of the linked item to a hook portion of the hook tool;
sliding the at least one bead from the body portion of the hook tool onto the linked item;
removing the linked item from the hook portion; and
securing the first end of the linked item to the second end with a clip.

12. The method as recited in claim 11, further comprising assembling a plurality of beads onto the body portion of the hook tool, wherein at least some of the plurality of beads includes tapered front and back sides that provide for adjacent beads to form a curve corresponding to a curve of the linked item when the first end and the second end are secured together with the clip.

13. The method as recited in claim 11, further comprising assembling at least one closed loop elastic member to the body portion of the hook and sliding the closed loop elastic member from the body portion of the hook onto the linked item with the at least one bead, wherein the closed loop elastic member holds the at least one bead in a desired location on the completed linked item.

14. The method as recited in claim 11, wherein the rectilinear inner opening is a square shape with rounded corners.

* * * * *